United States Patent [19]

Hayashi et al.

[11] 4,001,020

[45] Jan. 4, 1977

[54] DEVELOPING A SILVER HA1IDE EMULSION IN CONTACT WITH A HETEROCYCLIC THIONE AND A POLYALKYLENE OXIDE

[75] Inventors: Jun Hayashi; Akira Sato; Tadao Shishido, all of Minami-ashigara, Japan

[73] Assignee: Fuji Photo Film Co., Ltd., Minami-ashigara, Japan

[22] Filed: Feb. 10, 1975

[21] Appl. No.: 548,843

Related U.S. Application Data

[63] Continuation-in-part of Ser. No. 230,493, Feb. 29, 1972, abandoned.

[30] Foreign Application Priority Data

Mar. 4, 1971 Japan ..... 46-11156
Mar. 4, 1971 Japan ..... 46-11157

[52] U.S. Cl. ..... 96/66.3; 96/66.5; 96/66 R; 96/107; 96/109; 96/139

[51] Int. Cl.[2] ..... G03C 5/20

[58] Field of Search ..... 96/107, 109, 95, 66 R, 96/66.3, 66.5, 139

[56] References Cited

UNITED STATES PATENTS

| | | | |
|---|---|---|---|
| 3,006,759 | 10/1961 | Loria et al. | 96/55 |
| 3,081,170 | 3/1963 | Rauch et al. | 96/109 |
| 3,598,598 | 8/1971 | Herz | 96/109 |
| 3,656,958 | 4/1972 | Depoorter et al. | 96/139 |
| 3,832,180 | 8/1974 | Ramsay | 96/95 |
| 3,895,948 | 7/1975 | Shiba et al. | 96/95 |
| 3,901,709 | 8/1975 | Ebato et al. | 96/109 |

*Primary Examiner*—Won H. Louie, Jr.
*Attorney, Agent, or Firm*—Sughrue, Rothwell, Mion, Zinn & Macpeak

[57] ABSTRACT

A method for forming photographic images of particularly improved sharpness in which a photographic element is developed in the presence of an alkylene oxide polymer and a compound of the general formula (I)

wherein Q represents the atoms required to form an optionally substituted, defined heterocyclic ring and R is as defined in the specification, or a compound of the general formula (II)

wherein W is a sulfur, selenium or oxygen atom or a group >N—$R_3$, $R_1$, $R_2$, and $R_3$ each is an optionally substituted, defined alkyl group and Z represents the atoms required to form an optionally substituted, defined heterocyclic ring.

27 Claims, No Drawings

DEVELOPING A SILVER HALIDE EMULSION IN CONTACT WITH A HETEROCYCLIC THIONE AND A POLYALKYLENE OXIDE

CROSS-REFERENCE TO RELATED APPLICATIONS

This application is a continuation-in-part application of parent application Ser. No. 230,493, filed Feb. 29, 1972, for METHOD FOR FORMING PHOTOGRAPHIC IMAGES, by Jun Hayashi et al.

BACKGROUND OF THE INVENTION

1. Field of the Invention

This invention relates to a method for improving the sharpness of images in photographic light-sensitive elements.

2. Description of the Prior Art

When a photographic image of an object is recored with a black and white light-sensitive element or a multi-color light-sensitive element in which both use a silver halide emulsion, the reproducibility in the fine parts of the object is generally reduced. Such reduction in the sharpness of images is generally attributed to light scattering caused by the silver halide grains present in the layers of the light-sensitive element. In an attempt to prevent such a reduction in the image sharpness resulting from light scattering, there have been proposed, for example, a method wherein the thickness of the coating is decreased, a method wherein the silver halide emulsion grains are finely divided to reduce the light scattering and a method wherein the emulsion layer is dyed with a particular dye stuff. However, the decrease of the coating thickness is limited, for example, by the properties of the light-sensitive element and manufacturing techniques thereof. Furthermore, the method of finely dividing the emulsion grains or by dyeing the emulsion with a dye stuff are, in either case, accompanied by a marked reduction in sensitivity. It is, therefore, extremely difficult to prevent a reduction in the image sharpness caused by light scattering without any deleterious influence.

Furthermore, it is known, in silver halide light-sensitive elements, that their capability of reproducing the fine parts of an object reproduced, that is, the image sharpness, can be improved by the adjacency effect. As herein used, the term "adjacency effect" by which the image sharpness can be improved is intended to describe the phenomenon in which, when an image of a knife edge is formed on a light-sensitive element by exposure, the density in the high density side extremely adjacent to the edge is increased while that in the low density side is descreased, thereby apparently enhancing the contrast of the edge. (See, for example, C. E. K. Mees and T. H. James, The Theory of the Photographic Process, IIIrd E., 521–523, Macmillan Co., 1966).

By suitably utilizing the increase in the edge contrast employing the adjacency effect, the above-described reduction of the image sharpness resulting from light scattering can be compensated for and the capability of reproducing the fine parts of an object to be reproduced can be improved.

As methods for enhancing the image sharpness by the adjacency effect, there have been proposed, at present, for example, a method wherein the development process conditions are improved, for example, by diluting the developer or by using mild agitation during development, and a method in which light-sensitive elements themselves are improved, for example, by usng certain kinds of developing agents as described in U.S. Pat. Nos. 3,297,445 and 3,379,529, or certain kinds of couplers as described in U.S. Pat. Nos. 3,006,759, 3,148,062 and 3,227,554. The compounds used in the last case, however, are unstable or limited in their improvement and therefore the use of such compounds is very often limited.

SUMMARY OF THE INVENTION

An object of the present invention is to provide a method for obtaining photographic images which are improved in their sharpness by the adjacency effect.

We have now found that, when a silver halide photographic light-sensitive element containing at least one silver halide photographic emulsion layer on a support is developed to reduce the silver halide to silver, the image sharpness can be significantly enhanced by having present both (1) an alkylene oxide polymer selected from the group consisting of polyalkylene glycols and the condensation products of active-hydrogen containing organic compounds with polyalkylene oxides the alkylene oxide chain of said alkylene oxide polymer having a molecular weight of at least 300 and the alkylene oxide units contained therein having from 2 to 4 carbon atoms, and (2) a compound represented by the following general formula (I)

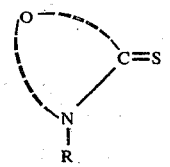

(I)

wherein Q represents the atoms necessary to form a heterocyclic ring selected from the group consisting of a thiazolidine-2-thione ring, an imidazolidine-2-thione ring, a selenazolidine-2-thione ring, a 1,3,4-thiadiazoline-2-thione ring, a 1,3,4-selenadiazoline-2-thione ring, a 4-thiazoline-2-thione ring, a 4-selenazoline-2-thione ring, and a 1,2-dihydropyridine-2-thione ring, said heterocyclic ring being unsubstituted or substituted on the atoms represented by Q with an unsubstituted alkyl group, a hydroxyalkyl group, a haloalkyl group, an unsubstituted aryl group, an alkyl-aryl group, a hydroxyaryl group, a haloaryl group, an alkylthio group, or an alkoxycarbonyl group; or Q represents the atoms necessary to form a heterocyclic ring selected from the group consisting of a benzothiazoline-2-thione ring, a benzoxazoline-2-thione ring, a benzimidazoline-2-thione ring, a benzselenazoline-2-thione ring, and a 1,2-dihydroquinoline-2-thione ring, said heterocyclic ring being unsubstituted on the atoms represented by Q with an unsubstituted alkyl group, an unsubstituted aryl group, an aryl group substituted by halogen, alkyl or alkoxy, an aralkyl group, an alkoxy group, a halogen atom, a trimethylene group or a tetramethylene group; and wherein R is an unsubstituted alkyl group having from 1 to 10 carbon atoms, an alkyl group having from 2 to 10 carbon atoms and substituted by hydroxy morpholino or aryl, an unsubstituted aryl group, an aryl group substituted by an alkyl group, an alkoxy group, or a halogen atom, or R is a 2-pyridyl group, or a compound represented by the general formula (II)

(II)

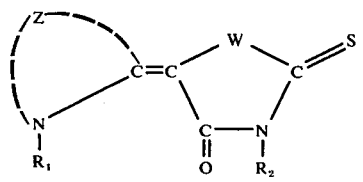

wherein W is a sulfur atom, a selenium atom, an oxygen atom or a >N—$R_3$ group, $R_1$, $R_2$ and $R_3$ each is unsubstituted alkyl group, a substituted alkyl group wherein the substituent is carboxy or sulfo, and wherein Z represents the atoms required to form a heterocyclic ring selected from the group consisting of a benzothiazole ring, a naphthothiazole ring, a benzoxazole ring, a naphthoxazole ring, a benzoselenazole ring, a naphthoselenazole ring, an indolenine ring, a benzimidazole ring, a naphthimidazole ring, and a 2-quinoline ring, said heterocyclic ring being unsubstituted or substituted on the benzene ring with a halogen atom, a phenyl group, an unsubstituted alkyl group, an alkoxy group, or a hydroxy group, or substituted on the naphthalene ring with an alkoxy group; or Z represents the atoms required to form a heterocyclic ring selected from the group consisting of a thiazoline ring, a thiazole ring, an oxazole ring, a selenazole ring, and a 2-pyridine ring, said heterocyclic ring being unsubstituted or substituted on the atoms represented by Z with an unsubstituted alkyl or an unsubstituted aryl group.

In the above formulae I and II, unless indicated otherwise, the substituents carried by substituted alkyl, substituted aryl, etc. are all unsubstituted.

DETAILED DESCRIPTION OF THE INVENTION

The combination according to the instant invention shows a super-additive effect upon the increase in the image sharpness. Thus, by combining the alkylene oxide polymer with a compound of the general formula (I) or (II), the image sharpness can be markedly increased, the comparison with the case in which each of these components are used alone. Such unexpected super-additive effect is in particular prominent when the silver halide emulsion used contains from 1 to 10 mole % of silver iodide. Alternatively, where the silver halide emulsion does not contain the silver iodide, this prominent super-additive effect can be also achieved when the developer used contains a small amount of soluble iodide, or when a compound capable of imagewise releasing iodide ions upon development such as 2iodo-5-pentadecylhydroquinone, is contained in the emulsion or in the developer, as is disclosed, for example in U.S. Pat. Nos. 3,297,445 and 3,006,759. The super-additive effect attained according to the present invention may be achieved upon developing using a conventional developer. The invention is applicable to development in general where silver halide is used as a photosensitive material. The mechanism of the effect is at present not understood, however, it is believed, that the inhibitory action on development resulting from the halide ion, in particular the iodide ion, released upon reduction of the silver halide to the silver deposit, is markedly potentiated by the presence of the two kinds of the compounds according to the present invention. The objects of the present invention, however, can be attained without presence of any iodide.

It is known in the art that the alkylene oxide polymer which may be used according to the invention has, in general, a sensitizing effect, and the sensitizing effect of the alkylene oxide polymer is inhibited only to a small extent when used together with the compounds of the general formula (I) or (II). Therefore, according to the present invention, there can be obtained both high sensitivity and images of high image sharpness.

As the alkylene oxide polymer which may be used in the invention is included any alkylene oxide polymer which can be used for the purpose of sensitization of photographic emulsions, although in particular preferred results may be obtained when using the polymers derived from alkylene oxides having from 2 to 4 carbon atoms, i.e. ethylene oxide, propylene oxide, and butylene oxide. The method of synthesizing the polymers from these alkylene oxide compounds is described for example in C. Ellis, The Chemistry of Synthetic Resins, 990–994, Rheinhold Publishing Co., 1935. The sensitization of silver halide emulsions by these polymers is described, for example, in U.S. Pat. Nos. 2,423,549, 2,441,389 3,017,271, and 3,062,647

The alkylene oxide polymers according to the present invention include, as well as polyalkylene glycols, a variety of alkylene oxide derivatives, i.e. the condensation products of polyalkylene oxides with an active hydrogen containing organic compounds. Examples of "active hydrogen containing organic compounds," i.e., compounds having a hydrogen atom which can be replaced by reaction of the compound with metallic sodium, methyl magnesium iodide or the like, include alcohols, amines, mercaptans, organic acids, amides, hydrocarbons such as acetylene, and those compounds having at least one active hydrogen or a methylene group between two electron-accepting groups, for example dibenzoyl methane

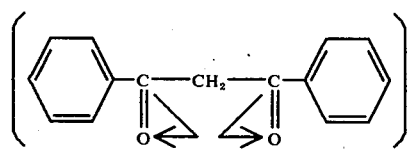

The condensation products of alkylene oxides with active hydrogen containing organic compounds, and methods for the preparation thereof are described, for example, in M. J. Schick Ed., Nonionic Surfactants, 1–246, Marcel Dekker Inc., N.Y., 1967.

More particularly, the alkylene oxide polymers which may be used according to the present invention include, the condensation products of polyalkylene oxides with glycols having from 8 to 18 carbon atoms as described in U.S. Pat. No. 2,240,472 and British Pat. No. 443,559; the condensation products of polyalkylene oxides with aliphatic alcohols as described in U.S. Pat. No. 1,970,578; the condensation products of polyalkylene oxides with fatty acids, such as lauric acid or glycine; the condensation products of polyalkylene oxides with aliphatic amines or aliphatic amides, such as glycine or laurylamide; the condensation products of polyalkylene oxides with phenoles, such as phenol; and the condensation products of polyalkylene oxides with hexitol ring dehydrated products as described in U.S. Pat. No. 2,400,532.

In any one of these alkylene oxide polymers, the polyalkylene oxide chain contained therein is required to have a molecular weight of at least 300 or more preferably 400 or more. In general, most preferred results can be obtained when the polyethylene glycol polymers or the condensation products of polyethylene oxide with active hydrogen containing organic compounds have a molecular weight of from 1,000 to 3,500 or more.

More detailed description will be given in the following with respect to the compounds of the general formula (I) or (II) which may be used in the instant invention.

In the general formula (I), Q represents the atoms necessary to form a thiazolidine-2-thione ring such as a thiazolidine-2-thione ring or a 4-methylthiazolidine-2-thione ring; an imidazolidine-2-thione ring such as a 1,3-dimethyl-imidazolidine-2-thione ring or a 1,3-diethylimidazolidine-2-thione ring; a selenazolidine-2-thione ring such as a selenazolidine-2-thione ring or a 4-methylselenazolidine-2-thione ring; a 1,3,4-thiadiazoline-2-thione ring such as a 1,3,4-thiadiazoline-2-thione ring, a 5-methyl-1,3,4-thiadiazoline-2-thione ring, a 5-ethylthio-1,3,4-thiadiazoline-2-thione ring, or a 5-[2-(4-phenyl-5-thio-1,3,4-thiadiazoline-2-yl)-mercaptoethylthio]-1,3,4-thiadiazoline-2-thione ring; a 1,3,4-selenadiazoline-2-thione ring such as a 1,3,4-selenadiazoline-2-thione ring or a 5-methyl-1,3,4-selenadiazoline ring; a 4-thiazoline-2-thione ring such as a 4-methyl-4-thiazoline-2-thione ring; a 4-phenyl-4-thiazoline-2-thione ring; a 4-methyl-5-ethoxycarbonyl-4-thiazoline-2-thione ring; a 4,5-trimethylenethiazoline-2-thione ring, or a 4,5-tetramethylenethiazoline-2-thione ring; a 4-selenazoline-2-thione ring such as a 4-selenazoline-2-thione ring, a 4-methyl-4-selenazoline-2-thione ring, or a 4-phenyl-4-selenazoline-2-thione ring; a 1,2-dihydropyridine-2-thione ring such as a 1,2-dihydropyridine-2-thione ring, or a 6-ethyl-1,2-dihydropyridine-thione ring; a benzthiazoline 2-thione ring such as a benzthiazoline-2-thione ring, a 6-methylbenzthiazoline-2-thione ring, a 6-ethylbenzthiazoline-2-thione ring, a 6-methoxy-benzthiazoline-2-thione ring, a 6-chlorobenzthiazoline-2-thone ring, or a 5-methylbenzthiazoline-2-thione ring; a benzoxazoline-2-thione ring such as a benzoxazoline-2-thione ring, a 6-ethylbenzoxazoline-2-thione ring, a 6-methoxybenzoxazoline-2-thione ring or a 5-methylbenzoxazoline-2-thione ring; a benzimidazoline-2-thione ring such as a 1,3-dimethylbenzimidazoline-2-thione ring, a 1,3-di-n-propylbenzimidazoline-2-thione ring, a 1,3-di-n-decylbenzimidazoline-2-thione ring, a 1,3-di-benzylbenimidazoline-2-thione ring, a 5-chloro-1,3-dimethylbenzimidazoline-2-thione ring or a 5-methyl-1,3-dibenzyl-benzimidazoline-2-thione ring; a benzoselenazoline-2-thione ring such as a benzoselenazoline-2-thione ring, a 6-ethylbenzoselenazoline-2-thione ring, a 6-methoxybenzoselenazoline-2-thione ring or a 6-chlorobenzoselanazoline-2-thione ring; or a 1,2-dihydroquinoline-2-thione ring such as a 1,2-dihydroquinoline-2-thione ring, a 6-methyl-1,2-dihydroquinoline-2-thione ring or a 6-chloro-1,2-dihydroquinoline-2-thione ring. The group R represents an unsubstitituted alkyl group containing from 1 to 10 carbon atoms, an alkyl group having 2 to 10 carbon atoms and substituted by a hydroxyl group, an aryl group, or a morpholino group, for example, a methyl group, an ethyl group, a propyl group, a hexyl group, a decyl group, a hydroxyethyl group, a benzyl group or a morpholinoethyl group; an aryl group which may be unsubstituted or substituted by an alkyl group, an alkoxyl group or a halogen atom, for example, a phenyl group, a 2-methylphenyl group, a 4-methoxyphenyl group or a 4-chlorophenyl group; or a 2-pyridyl group.

Among the compounds represented by the general formula (I), those having the following general formula (Ia), (Ib) or (Ic) given in particular preferred results.

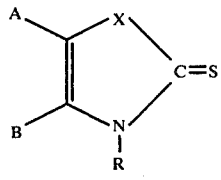

(Ia)

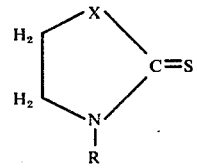

(Ib)

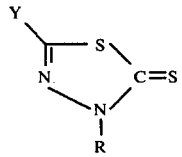

(Ic)

In the above described general formulas (I*a*), (I*b*) and (I*c*), X represents a sulfur atom, an oxygen atom, a selenium atom, a >N — R″ group or a — CH = CH — group, A and B each is a hydrogen atom, an unsubstituted alkyl group, an alkyl group substituted by a hdyroxy group or halogen atom, an unsubstituted aryl group, an aryl group substituted by an alkyl group, a hydroxy group or a halogen atom, or an alkoxycarbonyl group or represents the atoms required to form together a benzene ring, a benzene ring substituted by an unsubstituted alkyl group, an unsubstituted aryl group, a halogen substituted aryl group, and alkyl substituted aryl group or an alkoxy substituted aryl group, an alkoxy group or a halogen atom, or a cyclopentene ring or a cyclohexane ring. Y is an unsubstituted alkyl group, an alkoxy group or an alkylthio group and R and R″ each represents an unsubstituted alkyl group of 1 to 10 carbon atoms, an alkyl group having 4 to 10 carbon atoms substituted by a hydroxy group or a morpholino group, an aralkyl group substituted by a halogen atom or an alkoxy group, an unsubstituted aryl group, an aryl group substituted by an alkyl group, an alkoxy group or a halogen atom, or a 2-pyridyl group.

Then, in the above-described general formulas (I*a*), (I*b*) and (I*c*), A and B each is a hydrogen atom; an alkyl group having from 1 to 6 carbon atoms which may be unsubstituted or substituted by a hydroxyl group or a halogen atom, for example, a methyl group, an ethyl group, a butyl group, a hydroxyethyl group or a 2-chloroethyl group; an aryl group which may be unsubstituted or substituted by an alkyl group, a hydroxyl group or a halogen atom, for example, a phenyl group, a 4-methylphenyl group, a 4-hydroxy-phenyl group or a 3-chlorophenyl group; an alkoxycarbonyl group such as an ethoxycarbonyl group; the group required to form together an unsaturated ring having from 5 to 6 carbon atoms, for example a trimethylene group or a tetramethylene group; or the group required to form together a benzene ring which may be unsubstituted or substituted by an unsubstituted alkyl group such as a methyl group or an ethyl group, an aryl group such as a phenyl group, an alkoxyl group such as a methoxy group or an ethoxy group, or a halogen atom such as a chlorine atom or a bromine atom, and Y represents an unsubstituted alkyl group such as a methyl group, an ethyl group, an n-butyl group or an n-hexyl group, an alkoxyl group such as a methoxy group or an ethoxy group, or an alkylthio group such as a methylthio group, an ethylthio group, or a 2-(4-phenyl-5-thio-1,3,4-thiadiazolin-2-yl)-mercapto-ethylthio group.

Furthermore, the compounds represented by the general formula (II) which may be used in the present invention are generally known as merocyanine dyes and will be described in the following. In the general formula (II), W is a sulfur atom, a selenium atom, an oxygen atom or a $>N-R_3$ group, $R_1$, $R_2$, and $R_3$ each may be an unsubstituted alkyl group such as a methyl group, an ethyl group, an n-propyl group, n-butyl group, an iso-butyl group, or an n-amyl group; a substituted alkyl group wherein the substituent is carboxy or sulfo, i.e., carboxymethyl group, a carboxyethyl group, a sulfomethyl group, a sulfopropyl group, a sulfobutyl group, and Z represents the atoms required to form a thiazoline ring such as a thiazoline, 4-methyl thiazoline or 4-phenylthiazoline; a thiazole ring such as thiazole, 4-methylthiazole, 4-phenylthiazole, 5-methylthiazole or 4,5-dimethylthiazole; a benzothiazole ring such as benzothiazole, 4-chlorobenzothiazole; 5-chlorobenzothiazole, 6-chlorobenzothiazole, 7-chlorobenzothiazole, 5-methylbenxothiazole, 6-bromobenzothiazole, 5-phenylbenzothiazole, 5-methoxybenzothiazole, 6-methoxybenzothiazole, 5-iodobenzothiazole, 5-ethoxybenzothiazole, 6-hydroxybenzothiazole; a naphthothiazole ring such as naphtho[1,2]-thiazole, naphtho[2,1]-thiazole, 5-methoxynaphtho[2,1]-thiazole; an oxazole ring such as 4-methyloxazole, 5-methyloxazole, 4-phenyloxazole, 4-ethyloxazole or 4,5-dimethyloxazole; a benzoxazole ring such as benzoxazole, 5-chlorobenzoxazole, 5-methylbenzoxazole, 5-phenylbenzoxazole, 5,6-dimethylbenzoxazole, 5-methoxybenzoxazole, 5-hydroxybenzoxyazole; a naphthoxazole ring such as naphtho[2,1]oxazole or naphtho[1,2]oxazole; a selenazole ring such as 4-methylselenazole or 4-phenylselenazole; a benzoselenazole ring such as benzoselenazole, 5-chlorobenzoselenazole, 5-methoxybenzoselenazole, 5-hydroxybenzoselenazole or tetrahydrobenzoselenazole; a naphthoselenazole ring such as naphtho[1,2]selenazole or naphtho[2,1]selenazole; an indolenine ring such as 3,3-dimethylindolenine, 3,3-diethylindolenine or 3,3,7-trimethylindolenine; a benzimidazole ring such as 3-ethylbenzimidazole, 3-phenyl-benzimidazole, 5-chlorobenzimidazole or 1,3-diethyl-5,6-dichlorobenzimidazole; a naphthimidazole ring; 2-quinoline ring such as quinoline, 3-methylquinoline, 5-methylquinoline, 7-methylquinoline, 8-methylquinoline, 6-chloroquinoline, 6-methoxyquinoline or 6-hydroxyquinoline; or a 2-pyridine ring such as pyridine or 5-methylpyridine.

Among the compounds represented by the general formula (II), those having the following formula (II*a*) and (II*b*) give in particular preferred results:

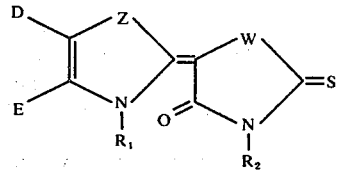

(IIa)

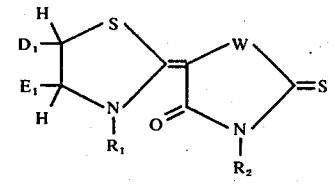

(IIb)

wherein D and E each represents a member selected from the group consisting of a hydrogen atom, an unsubstituted alkyl group, an unsubstituted aralkyl group, an alkoxycarbonyl group, an unsubstituted aryl group, an aryl group substituted by halogen, alkyl or alkoxy, the atoms which combine with each other to form a benzene ring, a benzene ring substituted by a halogen atom, a phenyl group, an unsubstituted alkyl group, an alkoxy group or a hydroxy group, the atoms which combine with each other to form a naphthalene ring or an alkoxy-substituted naphthalene ring, or the atoms which combine with each other to form a cyclohexene ring; Z represents a sulfur atom, an oxygen atom, a selenium atom, a group $>C(R_4)_2$, a group $>N-R_5$ or the group —CH=CH—; W represents a sulfur atom, a selenium atom, an oxygen atom or a group $>N-R_3$; $R_1$, $R_2$, $R_3$, and $R_5$ each represents a member selected from the group consisting of an unsubstituted alkyl group and an alkyl group substituted by a carboxy group or a sulfo group; $R_4$ represents an unsubstituted alkyl group; $D_1$ and $E_1$ each represents a hydrogen atom, an unsubstituted alkyl group, an unsubstituted aryl group or an aryl group substituted by halogen, alkyl or alkoxy.

Suitable examples of the alkylene oxide polymers which may be used in the present invention are as follows. The figures following each polymer represent the molecular weight of the polyalkylene oxide chain in the respective polymer.

| | | |
|---|---|---|
| Compound (A) | Polyethylene Glycol | 400 |
| (B) | Polyethylene Glycol | 16000 |
| (C) | Polyethylene Oxide Oleyl Ether | 1800 |
| (D) | Polyethylene Oxide Monolaurate | 6000 |
| (E) | Polyethylene Oxide Nonylphenyl Ether | 1150 |
| (F) | Polyethylene Oxide Sorbitan Monolaurate | 1500 |
| (G) | N-Methylmyristylamino Polyethylene Oxide | 1050 |
| (H) | Polypropylene Glycol-bis-(polyethylene-glycol) Ether* | 3000 |

*Polypropylene Glycol : Polyethylene Glycol= 3 : 2

Examples of the compounds of the general formulas (I) and (II) which may be used in the invention are as follows.

Compound (1)
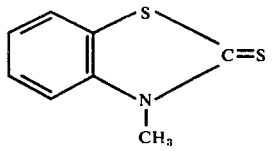
Compound (2)
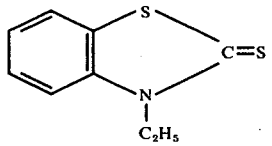
Compound (3)
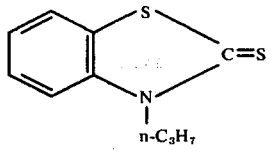
Compound (4)
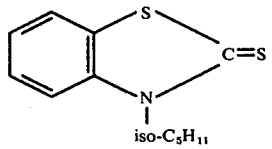
Compound (5)
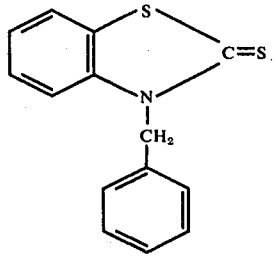
Compound (6)
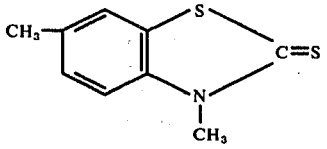
Compound (7)
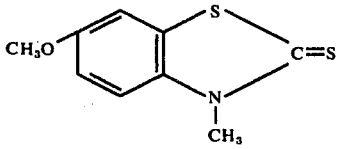
Compound (8)
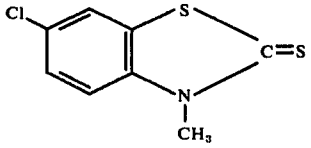
Compound (9)
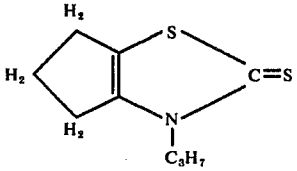

-continued
Compound (10)
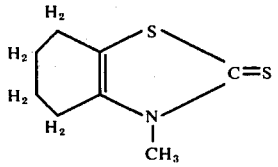
Compound (11)
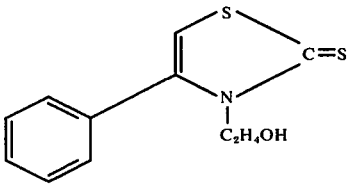
Compound (12)
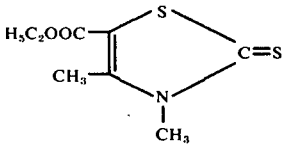
Compound (13)
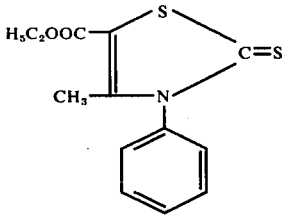
Compound(14)
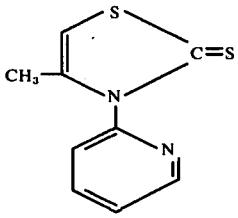
Compound (15)
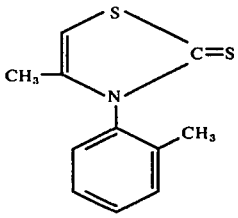
Compound (16)
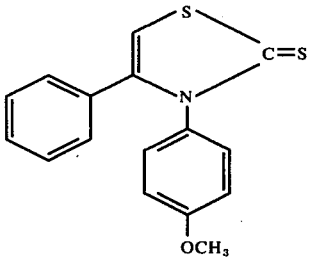

-continued
Compound (17)
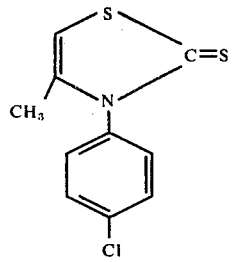
Compound (18)
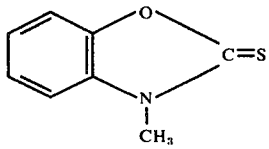
Compound (19)
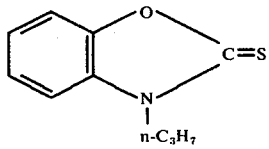
Compound (20)
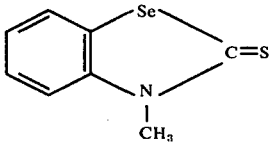
Compound (21)
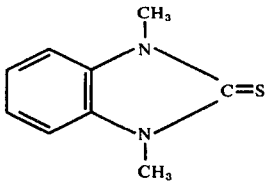
Compound (22)
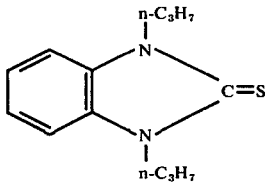
Compound (23)
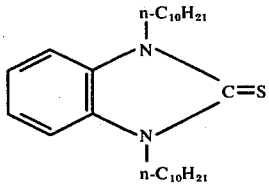
Compound (24)
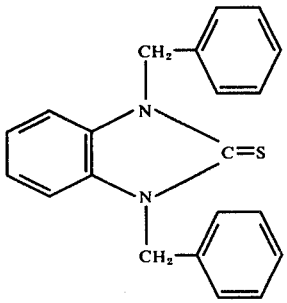

-continued
Compound (25)
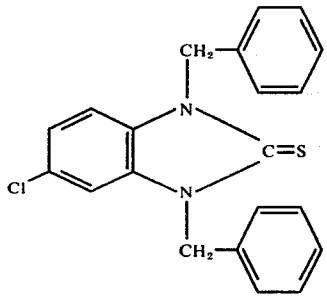
Compound (26)
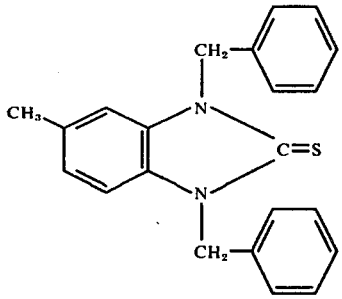
Compound (27)
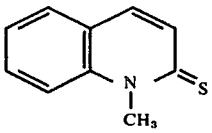
Compound (28)
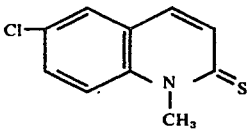
Compound (29)
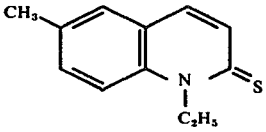
Compound (30)
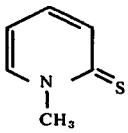
Compound (31)
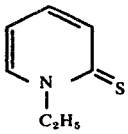
Compound (32)
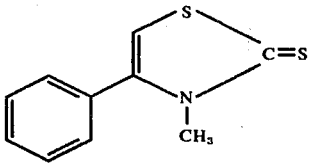

-continued
Compound (33)
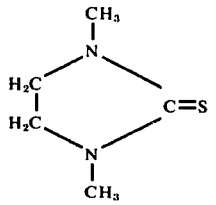
Compound (34)
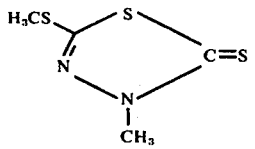
Compound (35)
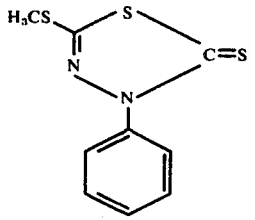
Compound (36)
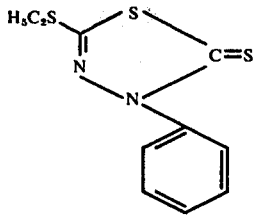
Compound (37)
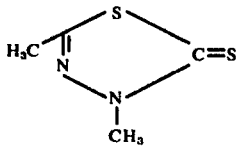
Compound (38)
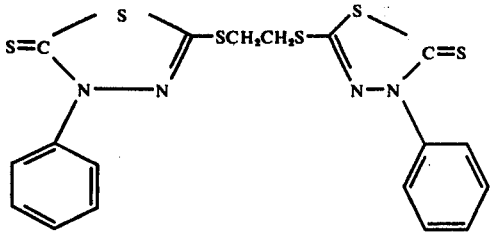
Compound (39)
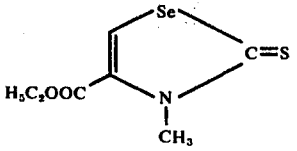
Compound (40)
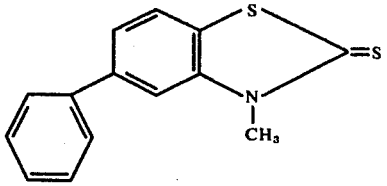

-continued
Compound (41)
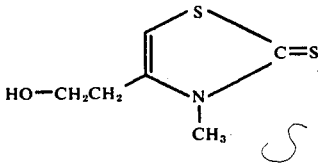
Compound (42)
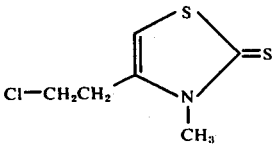
Compound (43)
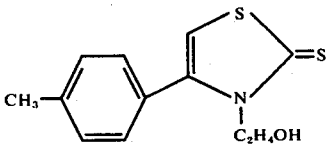
Compound (44)
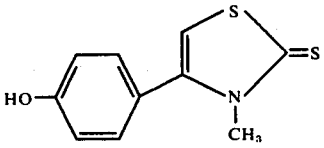
Compound (45)
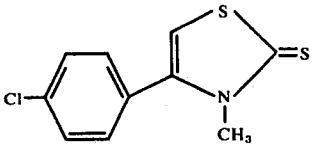
Compound (46)
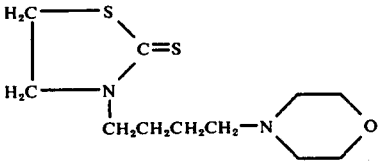
Compound (47)
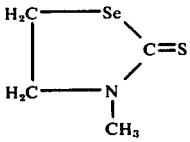
Compound (48)
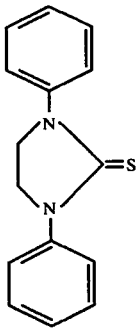

-continued
Compound (49)
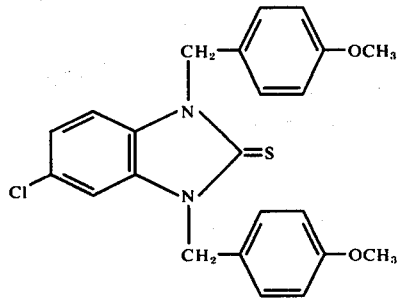
Compound (50)
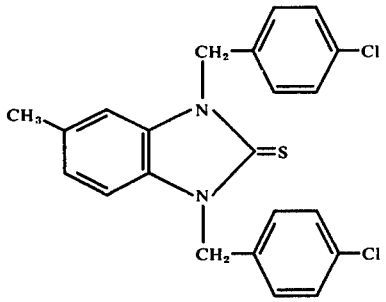
Compound (51)
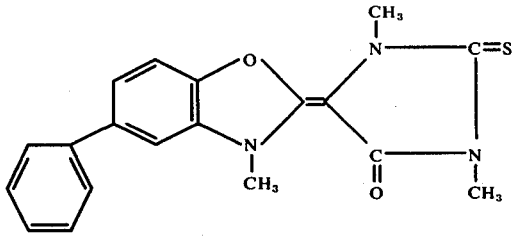
Compound (52)
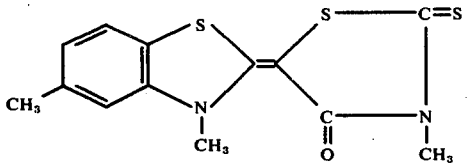
Compound (53)
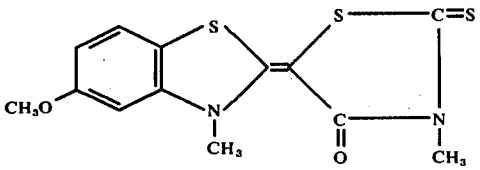
Compound (54)
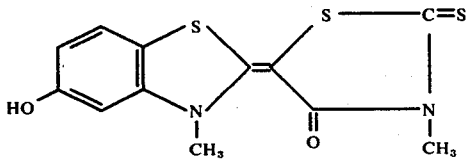
Compound (55)
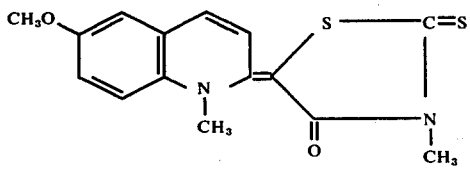

-continued
Compound (56)
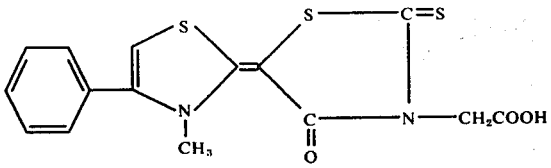
Compound (57)
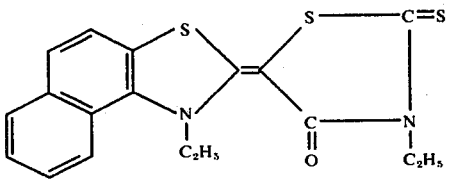
Compound (58)
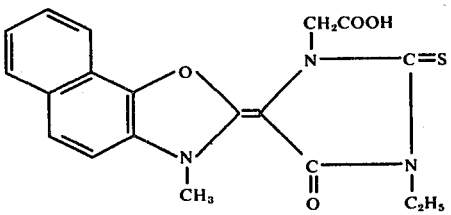
Compound (59)
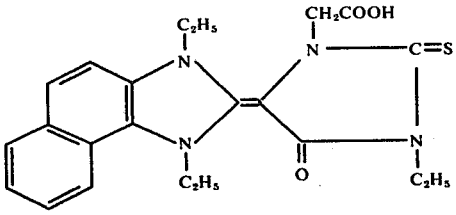
Compound (60)
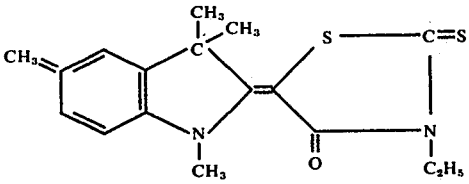
Compound (61)
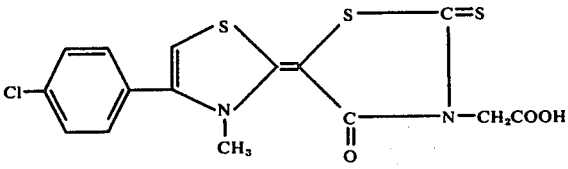
Compound (62)
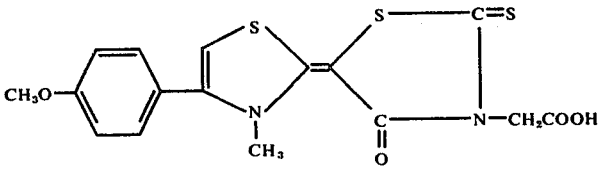
Compound (63)
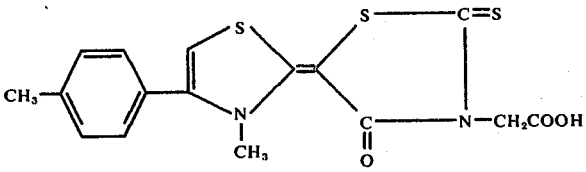

-continued
Compound (64)
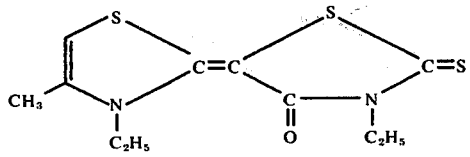
Compound (65)
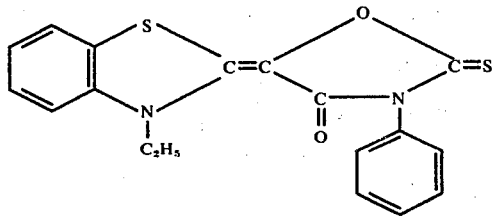
Compound (66)
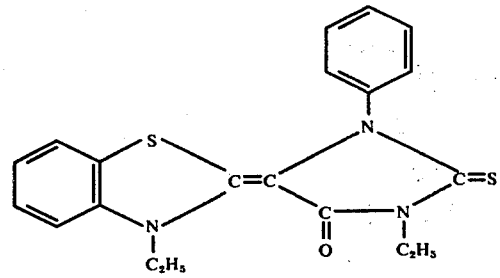
Compound (67)
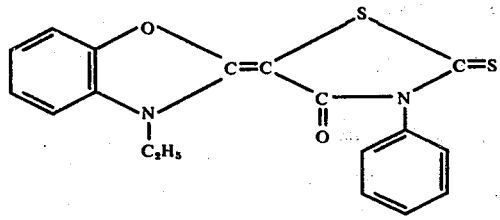
Compound (68)
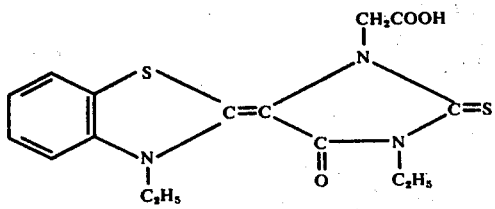
Compound (69)
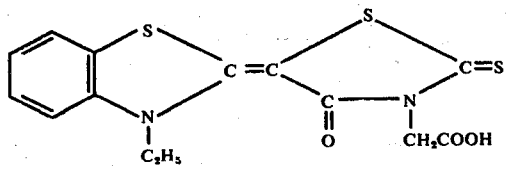
Compound (70)
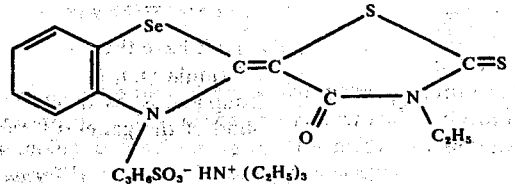

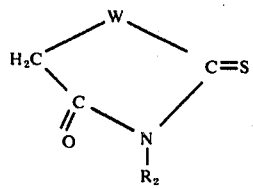

(IV)

wherein W and $R_2$ have the same meanings as defined in the general formula (II). The reaction is effected by heating the reactants in an alcoholic solvent in the presence of an organic base such as triethylamine as described, for example, in F. M. Harmer, The Cyanine Dyes and Related Compounds, 511, John Wiley & Sons Co., or U.S. Pat. Nos. 2,493,748 and 2,519,001.

In order to have both the alkylene oxide polymer and the compound of the general formula (I) or (II) according to the invention present upon the development of a silver halide photographic light-sensitive element, they can be previously incorporated into the silver halide photographic light-sensitive element by adding them into, for example, a silver halide photographic emulsion layer, a protective layer or interlayer. It is in general preferred to incorporate them, in combination, into said layer prior to the application of the layer onto the support. They can also be incorporated into a developer or other processing solution used in the process effected prior to the development, for example, a hardening bath. A combination of these methods also can be used. Furthermore, the alkylene oxide polymer and compound of the general formula (I) or (II) may be incorporated together into the light-sensitive element, developer or any other processing solution, although preferred results can also be obtained when either one of them is incorporated into the light-sensitive element and the other into the processing solution.

The amounts of the alkylene oxide polymer and compound of the general formula (I) or (II) used according to the present invention may be varied widely depending upon the properties of the photographic light-sensitive element and the development process used. When the alkylene oxide polymer is incorporated into a silver halide emulsion, its concentration may range from 0.1 to 10 g. per mole of silver halide, although preferred concentrations range from 0.25 to 5 g. per mole of silver halide. When the alkylene oxide polymer is incorporated into a developer, suitable concentrations thereof are from 0.05 to 5 g. per liter of developer. When the compound of the general formula (I) is incorporated into a silver halide emulsion, its concentration may range, in general, from 0.006 to 2.5 g. per mole of silver halide, although preferred concentrations are from 0.05 to 1.5 g. per mole of silver halide, while in the case of using the compound of the general formula (II), it is used in concentrations ranging from 0.003 to 1 g., although from 0.006 to 0.6 g., per mole of silver halide is preferred. When the compound of the general formula (I) is incorporated into a developer, it is used to advantage at concentrations ranging from 0.005 to 0.5 g. per liter of developer, while in the case of the compound of the general formula (II) suitable concentrations range from 0.003 to 0.3 g. per liter of developer. As the solvent for incorporating the compounds of I and II into the layer or to be used as developer solvents, there may be mentioned, for example, water, acetone or methanol.

The silver halide emulsions which may be used in the present invention may be those photographic emulsions comprising a silver halide such as silver bromide, silver iodide or silver chloride or a mixed silver halide such as silver chlorobromide, silver iodobromide or silver chloroiodobromide, although particularly preferred results can be obtained when at least one photographic emulsion layer contains from 1 to 10% of a silver chloroiodide, a silver iodobromide or a silver chlorobromoiodide emulsion.

Moreover, the silver halide photographic emulsions which may be used in the present invention may be chemically sensitized in any conventional manner in the art, using, for example, a labile sulfur containing compound such as sodium thiosulfate or allylthiocarbazide, a gold compound such as a complex salt of gold (I) with thiocyanic acid, a reducing agent such as stannous chloride, or any combination of these compounds. Furthermore, the silver halide photographic emulsions which may be used in the present invention may also be optically sensitized using a cyanine dye such as 1,1'-diethylcyanine iodide, 1,1'-diethyl-9-methylcarbocyanine bromide or anhydro-5,5'-diphenyl-9-ethyl-3,3'-di(2-sulfoethyl)-benzoxazolocarbocyanine hydroxide, alone or in any combination of these dyes. The silver halide photographic emulsions which may be used in the present invention may also contain a developing agent capable of releasing a development-inhibiting substance, for example, 2-iodo-5-pentadecylhydroquinone or 2-methyl-5-(1-phenyl-5-tetrazolylthio)-hydroquinone, a stablizer such as 4-hydroxy-6-methyl-1,3,3a,7-tetrazaindene, benzimidazole or 1-phenyl-5-mercaptotetrazole, a hardener such as formaldehyde or mucobromic acid and/or a wetting agent such as saponin or sodium alkylbenzenesulfonate.

The combination of compounds according to the present invention may be applied to any method in which a silver halide light-sensitive element is developed to reduce the silver halide into a silver deposit, thereby forming an image. For example, the combination according to the present invention may be applied to a method in which a black and white negative light-sensitive element, an X-ray light-sensitive element or the like is black-and-white-developed to give a negative silver image, a reversal photographic process in which a black and white negative light-sensitive element is first negatively developed and, after selectively removing the developed silver, the residual silver halide is developed to give a direct positive silver image, or a diffusion transfer process utilizing the phenomenon in which, when a light-sensitive layer and adjacent layer are kept in tight contact with each other, silver is imagewise dissolved and diffused from the former to the latter. Thus, the combination may be applied to any black and white photographic process utilizing a silver deposit as the image.

Furthermore, the combination according to the instant invention may also be applied to any color photographic process in which a multi-layer color light-sensitive element containing at least two photographic emulsion layers having incorporated therein a dispersion of silver halide in a hydrophilic colloidal medium is developed to form dye images of different colors in compliance with the degree of reduction of the silver halide into silver. For example, the combination according to the present invention may be used to advantage in a reversal color photographic process where a multilayer color light-sensitive element containing at least two silver halide photographic emulsion layers each sensitized to different wave length ranges is, after its exposure, developed with a black and white developer to obtain a negative silver image and then the silver halide grains in the areas not being developed with said black and white developer color-developed with a color developer to obtain a positive color image. In general, this reversal color photographic process is divided into two types, one being the so called "coupler-in-developer type color process" where the color image is formed by processing using a color developer containing diffusible couplers each capable of forming a different color, the other being the so called "coupler-in-emulsion type color process" where a multilayer color photographic light sensitive element each layer of which incorporates a diffusion resistant coupler capable forming a color different from that of the other layer(s) is processed with a color developer not containing couplers. The combination according to the present invention can be used to advantage in both types of reversal color processes.

In addition the combination according to the present invention may also be used in a process where a multilayer color photographic light sensitive element, containing at least two silver halide photographic emulsion layers having incorporated therein a diffusion resistant coupler sensitized to different wave length ranges, is color-developed immediately after its exposure to obtain a negative color image.

Furthermore, the combination according to the present invention may also be used in color diffusion transfer processes in which a light sensitive layer is kept in tight contact with an adjacent layer while a developer, coupler or dye is imagewise diffused from the former to the latter, as described, for example, in U.S. Pat. Nos. 2,559,643, 2,698,798 and 3,227,551. Moreover, the combination according to the present invention may also be used in the silver dye bleach color photography method in which the dye image is formed by bleaching the dye in the locality where the silver is present, as described, for example, in U.S. Pat. Nos. 2,020,775, and 2,410,025.

As the developer into which the compounds according to the present invention may be incorporated, there may be used any developer which is able to reduce silver halide grains to silver. In the case of black and white development, there may be used as developers the developing agent of which is a polyhydroxybenzene, an N-alkylaminophenol, a 1-phenyl-3-pyrazolidone, or any homologue or mixture of these. Homologues of the polyhydroxybenzenes include hydroquinone, pyrocatechol and pyrogallol, those of the N-monoalkylamino phenol include N-methylamino phenol and N-ethylamino phenol and those of the 1-phenyl-3-pyrazolidone include 1-phenyl-3-pyrazolidone and 1-phenyl-4,4-dimethyl-3-pyrazolidone. In the case of color development, there may be used, developers in which the developing agent is, for example, 4-amino-N,N-diethylaniline, 4-amino-3-methyl-N-methyl-N-(β-methylsulfonamidoethyl)aniline, or 4-amino-3-methyl-N-ethyl-(β-hydroxyethyl)aniline.

When the image sharpness is improved according to the present invention, a silver halide photographic light sensitive element may be processed at any conventional processing temperature, i.e. from 20° to 30° C, although it is also possible to process it at temperature ranging from 30° to 80° C or more.

The present invention will now be further explained in greater detail by reference to the following examples.

In these examples, the detection of the improvement according to the invention in image sharpness was made by measuring the response function (i.e. the Modulation Transfer Function, hereinafter referred to as MTF) and making a comparison based upon MTF values at a given frequency value. The measurement of MTF was made according to the method described by Takano, M. and Fujimura, I. in Hi-Hakai Kensa Vol. 16, pages 472–482, 1967.

In the examples given hereinafter, the emulsion thicknesses are on a dry basis.

EXAMPLE 1

A sulfur- and gold- sensitized high speed negative gelatino-silver iodobromide emulsion was divided into four parts. Into one of these parts was added a combination of the hereinbefore described Compounds (C) and (7) and into two of these parts was added separately the Compound (C) or the Compound (7). The emulsions thus prepared were each applied onto a film base and dried, and the respective MTF values measured by the MTF measuring method as described hereinbefore. The development was carried out at 20° C for 8 minutes using a developer of the following composition:

| | |
|---|---|
| N-Methyl-p-aminophenol Sulfate | 2 g. |
| Anhydrous Sodium Sulfite | 100 g. |
| Hydroquinone | 5 g. |
| Borax | 2 g. |
| Water to make | 1 liter |

The MTF values thus measured are shown in Table 1. In Table 1 the MTF values are shown at frequencies of 10 and 30 lines (L.) per 1 mm. and, the greater the value, the better the reproducibility is in the fine parts of the image, which is indicative of higher image sharpness. In Table 1 the results for the remaining emulsion containing neither of the Compounds (C) and (7) are also shown. In Table 1 are also shown, for reference, the sensitivity values obtained upon exposure using a NSG II type sensitometer (made by the Toshiba Company) and development using said developer, the values being those at a density corresponding to fog plus 0.10, and relative to the value, taken as 100, for the film containing neither of the Compounds (C) and (7).

Table 1

| Run Nos. | Compound | Amount g./mole Ag) | MTF values(%) 10L/mm | 30L/mm. | Relative Speed |
|---|---|---|---|---|---|
| 101 | (C) | 1.2 | 93 | 62 | 160 |
| 102 | (7) | 0.8 | 98 | 70 | 95 |
| 103 | (C) and (7) | 1.2 0.8 | 120 | 84 | 150 |

Table 1-continued

| Run Nos. | Compound | Amount g./mole Ag) | MTF values(%) 10L/mm | 30L./mm. | Relative Speed |
|---|---|---|---|---|---|
| 104 | None | — | 95 | 65 | 100 |

From the results contained in Table 1, it is evident that, when Compound (C) or (7) is used alone, the MTF values are almost the same as those obtained when neither of them is used, but when the Compounds (C) and (7) are incorporated in combination, the MTF values are markedly increased. In particular, the fact that the MTF value at a frequency of 10L./mm. exceeds 100 % when a combination of the Compounds (C) and (7) used is indicative of an intense production of the adjacency effect. Furthermore, from the relative speed values shown in Table 1, it is also evident that the sensitivity is markedly enhanced by the addition of the Compound (C), as is generally known, and the sensitizing effect is inhibited little when the Compound (C) used in combination with the Compound (7). As is evident from the foregoing, according to the present combination, an emulsion of high sensitivity and an image of high image sharpness can be obtained.

Example 2

A sulfur- and gold-sensitized high speed negative gelatino-silver iodobromide emulsion was divided into several test blocks and into one of the divided emulsions constituting the respective blocks was added a combination of compounds as shown in Table 2. The resulting emulsions were each applied onto a film base, dried and measured for MTF values, in the same manner as described in Example 1. The results thus obtained are shown in Table 2. From the Table 1, it is evident that, by incorporating the compounds according to the invention in combination, remarkably increased MTF values, i.e. higher image sharpness, can be obtained in comparison with those obtained when the compounds are used separately.

Table 2

| Run Nos. | Compound | Amount (g./mole Ag) | MTF values (%) 10L./mm. | 30L./mm. |
|---|---|---|---|---|
| 201 | (G) | 0.8 | 90 | 60 |
| 202 | (14) | 0.2 | 95 | 63 |
| 203 | (G) | 0.8 | | |
| | and | | 125 | 86 |
| | (14) | 0.2 | | |
| 211 | (G) | 0.5 | 88 | 62 |
| 212 | (2) | 0.8 | 89 | 62 |
| 213 | (G) | 0.5 | | |
| | and | | 122 | 83 |
| | (2) | 0.8 | | |
| 221 | (A) | 2.0 | 91 | 62 |
| 222 | (11) | 0.6 | 95 | 65 |
| 223 | (A) | 2.0 | | |
| | and | | 100 | 73 |
| | (11) | 0.6 | | |
| 231 | (A) | 5.0 | 90 | 63 |
| 232 | (1) | 0.05 | 88 | 64 |
| 233 | (A) | 5.0 | | |

Table 2-continued

| Run Nos. | Compound | Amount (g./mole Ag) | MTF values (%) 10L./mm. | 30L./mm. |
|---|---|---|---|---|
| | and | | 98 | 70 |
| | (1) | 0.05 | | |
| 241 | (B) | 0.25 | 94 | 58 |
| 242 | (23) | 1.5 | 96 | 64 |
| 243 | (B) | 0.25 | | |
| | and | | 108 | 77 |
| | (23) | 1.5 | | |
| 251 | (B) | 0.8 | 93 | 60 |
| 252 | (17) | 0.3 | 95 | 63 |
| 253 | (B) | 0.8 | | |
| | and | | 120 | 86 |
| | (17) | 0.3 | | |
| 261 | (H) | 1.0 | 90 | 63 |
| 262 | (31) | 0.2 | 91 | 63 |
| 263 | (H) | 1.0 | | |
| | and | | 117 | 84 |
| | (31) | 0.2 | | |
| 271 | (C) | 1.0 | 86 | 59 |
| 272 | (32) | 0.8 | 94 | 63 |
| 273 | (C) | 1.0 | | |
| | and | | 110 | 81 |
| | (32) | 0.8 | | |

EXAMPLE 3

A sulfur- and gold-sensitized fine grain positive gelatino-silver iodobromide emulsion was divided into several test blocks with each comprising three separate emulsions. Into each one of which emulsions was added the compound shown in Table 3, alone. The emulsions thus obtained were each applied onto a film base, dried and measured for MTF values, in the same manner as described in Example 2 except that a different developer from that used in Example 2 was used. The developer used was of the following composition and the development was carried out at 20° C for 4 minutes using a developer into which the compounds shown in Table 3 were added as shown in Table 3.

| | |
|---|---|
| N-Methyl-p-aminophenol Sulfate | 1.5 g. |
| Anhydrous Sodium Sulfite | 22.5 g. |
| Hydroquinone | 6.0 g. |
| Sodium Carbonate Monohydrate | 40.0 g. |
| Potassium Bromide | 1.0 g. |
| Water to make | 1 liter. |

The results thus obtained are shown in Table 3.

From the results shown in Table 3, it is evident that significantly increased MTF values, i.e. higher image sharpness, can be obtained by having present, upon development, both types of the compounds of the invention, in the photographic emulsion and developer, respectively.

Table 3

| Run Nos. | Compound | Amount added into emulsion (g./mole Ag) | developer (g./l.) | MTF values (%) 10L./mm. | 30L./mm. |
|---|---|---|---|---|---|
| 301 | (D) | 1.0 | — | 96 | 73 |
| 302 | (18) | — | 0.5 | 97 | 71 |
| 303 | (D) | 1.0 | — | | |
| | and | | | 128 | 96 |
| | (18) | — | 0.5 | | |

Table 3-continued

| Run Nos. | Compound | Amount added into emulsion (g./mole Ag) | developer (g./l.) | MTF values (%) 10L./mm. | 30L./mm. |
|---|---|---|---|---|---|
| 311 | (E) | — | 1.5 | 94 | 70 |
| 312 | (38) | 0.1 | — | 95 | 76 |
| 313 | (E) | — | 1.5 | | |
| | and | | | 114 | 88 |
| | (38) | 0.1 | — | | |
| 321 | (A) | — | 5.0 | 93 | 70 |
| 322 | (20) | 0.1 | — | 98 | 75 |
| 323 | (A) | — | 5.0 | | |
| | and | | | 110 | 85 |
| | (20) | 0.1 | — | | |
| 331 | (D) | 1.0 | — | 90 | 72 |
| 332 | (25) | — | 0.1 | 96 | 74 |
| 333 | (D) | 1.0 | — | | |
| | and | | | 122 | 95 |
| | (25) | — | 0.1 | | |

EXAMPLE 4

Developers of the same composition as shown in Example 1 were prepared and, into each of the developers the compound or compounds shown in Table 4 were added. Using the same light-sensitive element as used in Run No. 104 of Example 1. i.e. the light sensitive element containing neither of the compounds of the invention, the development was carried out with each developer described above and the MTF value was measured, in the same manner as described in Example 2. The results thus obtained are shown in Table 4. From the results shown in Table 4, it is evident that, when the two types of the compounds of the invention are incorporated in combination with each other, higher MTF values, i.e. higher image sharpness, can be obtained in comparison with those obtained when they are incorporated separately.

Table 4

| Run Nos. | Compound | Amount (g./l. developer) | MTF values (%) 10L./mm. | 30L./mm. |
|---|---|---|---|---|
| 401 | (E) | 0.05 | 90 | 61 |
| 402 | (21) | 0.005 | 92 | 63 |
| 403 | (E) | 0.05 | | |
| | and | | 98 | 69 |
| | (21) | 0.005 | | |
| 411 | (E) | 0.2 | 91 | 63 |
| 412 | (21) | 0.02 | 88 | 65 |
| 413 | (E) | 0.2 | | |
| | and | | 121 | 79 |
| | (21) | 0.02 | | |
| 421 | (G) | 0.5 | 89 | 60 |
| 422 | (29) | 0.1 | 95 | 63 |
| 423 | (G) | 0.5 | | |

Table 4-continued

| Run Nos. | Compound | Amount (g./l. developer) | MTF values (%) 10L./mm. | 30L./mm. |
|---|---|---|---|---|
| | and | | 128 | 84 |
| | (29) | 0.1 | | |

EXAMPLE 5

A sulfur- and gold-sensitized Fine grain negative gelatino-silver iodobromide emulsion was devided into two test blocks which were then each subdivided into 3 emulsion test blocks. Into these emulsion test blocks the compound or compounds shown in Table 5 were added in a manner as described in Table 5. The resulting emulsions were each applied onto a film base, dried and measured for MTF values. The development was carried out by means of a reversal color development in sequence:

| | | Temperature | Time |
|---|---|---|---|
| 1. | Negative Development. | 27° C | 7 min. |
| 2. | Wash in Water. | 27° C | 2 min. |
| 3. | Reversal Flash Exposure. | | |
| 4. | Color Development. | 27° C | 5 min. |
| 5. | Wash in Water. | 27° C | 1 min. |
| 6. | Bleach of Silver. | 27° C | 5 min. |
| 7. | Fix. | 27° C | 3 min. |
| 8. | Wash in Water and Dry. | | |

The formulation of each processing bath used above is as follows.

| | |
|---|---|
| 1. Negative Developer. | |
| N - Methyl - p - aminophenol Sulfate | 2 g. |
| Anhydrous Sodium Sulfite | 90 g. |
| Hydroquinone | 8 g. |
| Sodium Carbonate Monohydrate | 52.5 g. |
| Potassium Bromide | 5 g. |
| Potassium Thiocyanate | 1.0 g. |
| Water to make | 1 liter. |
| 2. Color Developer. | |
| Sodium Sulfite | 5.0 g. |
| 4 - Amino - 3 - methyl - N, N - diethylaniline-Hydrochloride | 2.0 g. |
| Potassium Bromide | 0.2 g. |
| 1 - Phenyl - 3 - ( 3- nitrobenzoylamino) - 5 - pyrazolone | 1.4 g. |
| Caustic Soda | 2.5 g. |
| n-Butylamine | 5 ml. |
| Water to make | 1 liter. |
| 3. Silver Bleaching Solution. | |
| Red Prussiate of Potash | 100 g. |
| Potassium Bromide | 10 g. |
| Borax | 2 g. |
| Boric Acid | 1 g. |

-continued

| | |
|---|---|
| Water to make | 1 liter. |
| 4. Fixing Solution. | |
| Sodium Thiosulfate | 150 g. |
| Sodium Sulfite | 10 g. |
| Water to make | 1 liter. |

The MTF values of the magenta dye images thus obtained are shown in Table 5. From the results shown in Table 5, it is evident that by the combination of the compounds according to the present invention, the MTF values are remarkably increased, i.e. images of higher sharpness can be obtained.

Table 5

| Run Nos. | Compound | Amount (g./mole Ag) | MTF values (%) 10L./mm. | 30L./mm. |
|---|---|---|---|---|
| 501 | (E) | 1.0 | 72 | 33 |
| 502 | (13) | 0.8 | 75 | 36 |
| 503 | (E) and (13) | 1.0 0.8 | 89 | 56 |
| 511 | (F) | 1.0 | 70 | 31 |
| 512 | (34) | 0.6 | 73 | 34 |
| 513 | (F) and (34) | 1.0 0.6 | 97 | 61 |

EXAMPLE 6

A sulfur-sensitized gelatino-silver chlorobromide emulsion was divided into three parts, into which the compound or compounds shown in Table 6 were added in a manner as shown in Table 6. The MTF values of the thus obtained emulsions were estimated. The development was carried out at 27 C for 4 minutes using a developer of the following composition.

| | |
|---|---|
| N - Methyl - p aminophenol Sulfate | 5 g. |
| Anhydrous Sodium Sulfite | 90 g. |
| Caustic Soda (10%) | 10 cc. |
| Hydroquinone | 1.7 g. |
| 2 - Iodo - 3, 5, 6 -trimethylhydroquinone | 0.3 g. |
| Sodium Carbonate Monohydrate | 52.5 g. |
| Potassium Bromide | 3.5 g. |
| Potassium Thiocyanate | 1.0 g. |
| Water to make | 1 liter |

The results thus obtained are shown in Table 6, from which it is evident that, by the combination according to the invention, the MFT values are markedly increased, i.e. images of higher sharpness can be obtained.

Table 6

| Run Nos. | Compound | Amount (g./mole Ag) | MTF values(%) 10L/mm. | 30L/mm. |
|---|---|---|---|---|
| 601 | (E) | 0.8 | 97 | 85 |
| 602 | (9) | 0.3 | 99 | 84 |
| 603 | (E) and (9) | 0.8 0.3 | 125 | 98 |

EXAMPLE 7

Into a sulfur— and gold-sensitized high speed negative gelatino-silver iodobromide emulsion containing 1 mole of the silver halide was added 0.2 g. of anhydro — 5, 5′ — dichloro-9 - ethyl - 3, 3′ - di - sulfopropylselenacarbo-cyanine hydroxide as a red-sensitizing dye and 400g of an emulsified coupler prepared by 1 g. of N - n - dodecyl - 1 - hydroxy - 4 - chloro-2 - naphthoic acid amide as a cyan coupler into 2 ml. of dibutyl phthalate and then emulsifying and dispersing the solution using a dispersing agent such as sodium dodecyl sulfate in 20 g of a 10% gelatin solution. After the emulsion was adjusted to a pH of 6.5, it was applied on a film base at a thickness of 5 microns.

On top of the coating thus formed was applied at a thickness of 6 microns an emulsion prepared by adding into a sulfur- and gold sensitized high speed negative gelatine-silver iodobromide emulsion containing 1 mole of the silver halide 0.16 g. of anhydro - 5, 5′ - diphenyl - 9 - ethyl - 3,3′ - di - (2- sulfoethyl) - benzoxazolocarbo-cyanine hydroxide as a green- sensitizing dye and 500 g. of an emulsified dispersion of a coupler prepared first by dissolving, under heating 1 g. of 1 - phenyl - 3 - dodecylamido - 5 - pyrazolone as a magenta coupler into 3 ml. of dibutyl phthalate and then by dispersing the solution into a 10% gelatin solution using the above-described dispersing agent; and then adjusting the emulsion to a pH of 6.5. The application was effected via a thin gelatin coating layer.

On top of the coating thus formed was further applied a yellow filter layer comprising colloidal silver, on which layer was then coated an emulsion layer at a thickness of 5 microns. This emulsion was prepared by adding into a sulfur- and gold-sensitized high speed negative gelatino-silver iodobromide emulsion the compound (s) shown in Table 7 in accordance with the formulation shown in Table 7, and then adding into the mixture 1.6 g. of 4-hydroxy-6 methyl - 1,3,3a,-7 -tetrazaindene as a stabilizer, and 550 g. of an emulsified dispersion of the coupler and finally adjusting the emulsion to a pH of 6.5. This emulsified dispersion of coupler was prepared by dissolving, under heating, 1 g. of 4 - dodecyl - benzoyl -2′ - methoxy - acetanilide into 2.5 ml. of dibutyl phthalate, then dispersing the solution into a 10% gelatin solution using the above-described dispersing agent.

The multilayer color light-sensitive elements thus prepared were then measured for their MTF value. Exposure was adjusted using a filter so that the resulting image became gray in color and the measurement made through a green filter. The development was effected in the following sequence:

| | Temperature | Time |
|---|---|---|
| 1. Negative Development | 24° C | 10 min. |
| 2. Wash in Water. | 24° C | 3 min. |
| 3. Reversal Flash Exposure. | | |
| 4. Color Development. | 24° C | 15 min. |
| 5. Wash in Water. | 24° C | 2 min. |
| 6. Bleaching of Silver. | 24° C | 5 min. |
| 7. Fix. | 24° C | 3 min. |
| 8. Wash in Water and Dry. | | |

The processing solutions used were prepared in accordance with the same formulations as described in Example 6, except for the color developer which had the following composition:

| | | |
|---|---|---|
| Color Developer | | |
| Benzyl Alcohol | 6 | ml. |
| Sodium Sulfite(anhydrous) | 4 | g. |
| Sodium Triphosphate | 40 | g. |
| Caustic Soda | 1.5 | g. |
| Potassium Bromide | 0.5 | g. |
| Ethylene Diamine | 5 | ml. |
| Citrazinic Acid | 1 | g. |
| 4 - Amino - 3 - methyl - N - ethyl - N-(-methylsulfonamidoethyl)aniline Sulfate | 11 | g. |
| Water to make | 1 | liter. |

The MTF values of the color images thus obtained are shown in Table 7. From the results contained in Table 7, it is evident that, by the combination according to the invention, the MTF values are markedly increased, i.e. images of higher sharpness can be obtained.

Table 7

| Run Nos. | Compound | Amount (g./mole Ag) | MTF values (%) 10L./mm. | 30L./mm. |
|---|---|---|---|---|
| 701 | (C) | 0.8 | 65 | 20 |
| 702 | (1) | 0.8 | 68 | 23 |
| 703 | (C) and (1) | 0.8 0.8 | 79 | 34 |

EXAMPLE 8

A sulfur- and gold-sensitized high speed negative gelatino-silver iodobromide emulsion was divided into 4 parts, into 3 parts of which was added the aforementioned Compound (C) or (39) or a combination of the Compounds (C) and (39) in a manner as shown in Table 8. The resulting emulsions were each applied onto a film base, dried and measured for their MTF value. The development was carried out at 20° C for 8 minutes using the developer of the same composition as described in Example 1.

Table 8

| Run Nos. | Compound | Amount (g./mole Ag) | MTF values (%) 10L./mm. | 30L./mm. | Relative Speed |
|---|---|---|---|---|---|
| 801 | (C) | 1.0 | 94 | 60 | 168 |
| 802 | (64) | 0.1 | 97 | 65 | 98 |
| 803 | (C) and (64) | 1.0 0.1 | 118 | 80 | 160 |
| 804 | None | — | 92 | 61 | 100 |

When the Compound (C) is used in combination with the Compount (64), the MTF value at a frequency of 10 L/mm. exceeds 100%, which is clearly indicative of an intense occurrence of the adjacency effect. Furthermore, from the relative speed values shown in Table 8, it is also evident that the sensitizing effect of the Compound (C) is inhibited little when the Compound (C) is used in combination with the Compound (64). As is evident from the foregoing, according to the combination of the invention, there can be obtained an emulsion of high sensitivity and an image of high image sharpness.

EXAMPLE 9

A sulfur- and gold- sensitized high speed negative gelatino-silver iodobromide emulsion was divided into several test blocks which were each subdivided into three parts, and into the thus divided emulsions were added the compounds shown in Table 9 in a manner as shown in Table 9. The thus obtained emulsions were applied, dried and measured for their MTF value in the same manner as described in Example 1. The results thus obtained are shown in Table 9. From the results contained in Table 9, it is evident that, by incorporating a combination of the compounds according to the invention, there can be obtained markedly increased MTF values, i.e. higher image sharpness, in comparison with those obtained when the compounds are used alone.

Table 9

| Run Nos. | Compound | Amount (g./mole Ag) | MTF values(%) 10L./mm. | 30L./mm. |
|---|---|---|---|---|
| 901 | (B) | 0.25 | 91 | 59 |
| 902 | (67) | 0.2 | 94 | 64 |
| 903 | (B) and (67) | 0.25 0.2 | 120 | 81 |
| 911 | (H) | 0.5 | 89 | 60 |
| 912 | (72) | 0.006 | 88 | 60 |
| 913 | (H) and (72) | 0.5 0.006 | 101 | 74 |
| 921 | (F) | 1.0 | 90 | 59 |
| 922 | (70) | 0.6 | 96 | 65 |
| 923 | (F) and (70) | 1.0 0.6 | 128 | 88 |
| 931 | (A) | 5.0 | 88 | 59 |
| 932 | (66) | 0.15 | 90 | 61 |
| 933 | (A) and (66) | 5.0 0.15 | 111 | 79 |
| 941 | (C) | 0.5 | 91 | 62 |
| 942 | (69) | 0.2 | 97 | 66 |
| 943 | (C) and (69) | 0.5 0.2 | 124 | 84 |
| | | (g./mole Ag) | 10L./,m. | 30L./mm. |
| 961 | (E) | 0.6 | 93 | 60 |
| 962 | (74) | 0.05 | 90 | 63 |
| 963 | (E) and (74) | 0.6 0.05 | 109 | 76 |
| 971 | (E) | 1.2 | 88 | 60 |
| 972 | (76) | 0.05 | 91 | 64 |
| 973 | (E) and (76) | 1.2 0.05 | 114 | 77 |

EXAMPLE 10

A sulfur- and gold- sensitized fine grain positive gelatino-silver iodobromide emulsion was divided into several test blocks which were each subdivided into 3 parts. Into each emulsion was added the compounds shown in Table 10 in a manner as shown in Table 10. The thus obtained emulsions were each applied onto a film base and the MTF value measured in the same manner as described in Example 2 except that a different developer from that used in Example 2 was used. The developers used were the same as those used in Example 3. The development was carried out at 20° C for 4 minutes using the developers into which the compounds shown in Table 10 had been added in a manner as shown in Table 10.

The results thus obtained are shown in Table 10. From the results contained in Table 10, it is evident that a much higher image sharpness can be obtained, by having present upon development, both types of the compounds of the invention, in the photographic emulsion and developer, respectively.

Table 10

| Run Nos. | Compound | Amount Added into Emulsion (g./mole Ag) | Developer (g./l.) | MFT values(%) 10L./mm | 30L./mm. |
|---|---|---|---|---|---|
| 1001 | (G) | 0.8 | — | 92 | no |
| 1002 | (64) | — | 0.3 | 94 | 71 |
| 1003 | (G) | 0.8 | — | | |
| | and | | | 115 | 80 |
| | (64) | — | 0.3 | | |
| 1011 | (A) | — | 1.0 | 88 | 68 |
| 1012 | (67) | 0.1 | — | 94 | 74 |
| 1013 | (A) | — | 1.0 | | |
| | and | | | 101 | 79 |
| | (67) | 0.1 | — | | |
| 1021 | (A) | — | 5.0 | 93 | 71 |
| 1022 | (73) | 0.1 | — | 97 | 74 |
| 1023 | (A) | — | 5.0 | | |
| | and | | | 118 | 85 |
| | (73) | 0.1 | | | |

EXAMPLE 11

Developers of the same composition as in Example 1 were prepared and, into each of the developers the compound or compounds shown in Table 11 were added. Using the same light-sensitive element as used in Run No. 804 of Example 8, the development was carried out with each developer described above and the MTF value was measured in the same manner as in Example 2. The results thus obtained are shown in Table 11. From the results contained in Table 11, it is evident that, when the two types of the compounds of the invention are incorporated in combination with each other, a much higher image sharpness can be obtained, in comparison with that obtained when they are incorporated separately.

Table 11

| Run Nos. | Compound | Amount (g./l.developer) | MTF Values (%) 10L./mm. | 30L./mm. |
|---|---|---|---|---|
| 1101 | (E) | 0.5 | 88 | 60 |
| 1102 | (64) | 0.003 | 91 | 64 |
| 1103 | (E) | 0.5 | | |
| | and | | 100 | 71 |
| | (64) | 0.003 | | |
| 1111 | (E) | 0.05 | 90 | 60 |
| 1112 | (71) | 0.03 | 88 | 62 |
| 1113 | (E) | 0.05 | | |
| | and | | 111 | 78 |
| | (71) | 0.03 | | |

EXAMPLE 12

A sulfur- and gold-sensitized fine grain negative gelatino-silver iodobromide emulsion was divided into two test blocks, each of which was further subdivided into three. Into each of these emulsions the compound or compounds shown in Table 12 were added in a manner as shown in Table 12. The thus obtained emulsions were each applied onto a film base, dried and the MTF value measured. The development was carried out by means of a reversal color development using the same formulation and processing sequence as described in Example 5. The MTF values of the thus obtained magenta dye images are shown in Table 12, from which it is evident that, according to the combination of the invention the image sharpness can be significantly enhanced.

Table 12

| Run Nos. | Compound | Amount (g./mole Ag) | MTF values (%) 10L./mm. | 30L./mm. |
|---|---|---|---|---|
| 1201 | (D) | 0.8 | 70 | 31 |
| 1202 | (70) | 0.2 | 74 | 36 |
| 1203 | (D) | 0.8 | | |
| | and | | 90 | 55 |
| | (70) | 0.2 | | |
| 1211 | (E) | 0.5 | 68 | 29 |
| 1212 | (75) | 0.1 | 71 | 33 |
| 1213 | (E) | 0.5 | | |
| | and | | 95 | 59 |
| | (75) | 0.1 | | |

EXAMPLE 13

A sulfur-sensitized gelatino-silver chlorobromide emulsion was divided into three parts into which the compound or compounds as shown in Table 13 in a manner as shown in Table 13 were added. The emulsions thus obtained were each applied onto a film base, dried and the MTF value measured. The development was carried out at 27° C for 4 minutes using a developer of the same composition as Example 6.

Table 13

| Run Nos. | Compound | Amount (g./mole Ag) | MTF values (%) 10L./mm. | 30L./mm. |
|---|---|---|---|---|
| 1301 | (E) | 1.0 | 94 | 83 |
| 1302 | (65) | 0.15 | 99 | 86 |
| 1303 | (E) | 1.0 | | |
| | and | | 129 | 99 |
| | (65) | 0.15 | | |

From the results shown in Table 13, it is evident that, according to the present combination, the image sharpness can be markedly enhanced.

EXAMPLE 14

Example 7 was repeated except that, in place of the Compounds (C) and (1), Compound (C) and or (68) in the amounts shown in Table 14, were added, thereby giving mutilayer color light sensitive elements and the MTF values thereof were measured.

From the MTF values of the color dye images shown in Table 14, it is evident that, by the combination according to the invention the image sharpness can be remarkedly increased.

Table 14

| Run Nos. | Compound | Amount (g./mole Ag) | MTF values 10L./mm. | 30L./mm. |
|---|---|---|---|---|
| 1401 | (C) | 1.0 | 60 | 22 |
| 1402 | (68) | 0.1 | 64 | 25 |
| 1403 | (C) and (68) | 1.0 0.1 | 84 | 36 |

Good results were also obtained when the polyalkylene oxide polymers and the compounds of the general formula I or II othe than those described in Examples 1 to 14 were used. Furthermore, good results were also obtained in other developing processes than those employed in these examples.

The invention has been described in considerable detail with particular reference to preferred embodiments thereof, but it will be understood that variations and modifications can be effected within the spirit and scope of the invention as described hereinabove and as defined in the appended claims.

What is claimed is:

1. In a method for obtaining photographic images of high sensitivity and high image sharpness by developing a silver halide photographic emulsion layer containing a latent silver image, the improvement which comprises developing said element with a developing agent selected from the group consisting of (a) a mixture of a polyhydroxybenzene and an N-alkylaminophenol, (b) a 1-phenyl-3-pyrazolidone and (c) a mixture of (a) and (b), and in contact with 1. an alkylene oxide polymer selected from the group consisting of polyalkylene glycols and condensation products of polyalkylene oxides with active hydrogen containing organic compounds, wherein the alkylene oxide chain of said alkylene polymer has a molecular weight of at least 300 and wherein said alkylene oxide units comprising said chain have from 2 to 4 carbon atoms, and
2. a heterocyclic compound not containing an unsubstituted N hetero atom represented by the general formula (I)

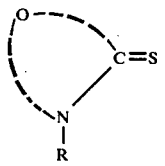

(I)

wherein Q represents the atoms necessary to form a heterocyclic ring selected from the group consisting of a thiazolidine-2-thione ring, an imidazolidine-2-thione ring, a selenazolidine-2-thione ring, a 1,3,4-thiadiazoline-2-thione ring, a 1,3,4-selenadiazoline-2-thione ring, a 4-thiazoline-2-thione ring, a 4-selenazoline-2-thione ring, and a 1,2-dihydropyridine-2-thione ring, said heterocyclic ring being unsubstituted or substituted on the atoms represented by Q with an unsubstituted alkyl group, a hydroxyalkyl group, a haloalkyl group, an unsubstituted aryl group, an alkylaryl group, a hydroxyaryl group, a haloaryl group, an alkylthio group, or an alkoxycarbonyl group; or Q represents the atoms necessary to form a heterocyclic ring selected from the group consisting of a benzothiazoline-2-thione ring, a benzoxazoline-2-thione ring, a benzimidazoline-2-thione ring, a benzselenazoline-2-thione ring and a 1,2-dihydroquinoline-2-thione ring, said heterocyclic ring being unsubstituted or substituted on the atoms represented by Q with an unsubstituted alkyl group, an unsubstituted aryl group, an aryl group substituted by halogen, alkyl or alkoxy, an aralkyl group, an alkoxy group, a halogen atom, a trimethylene group or a tetramethylene group; and wherein R is an unsubstituted alkyl group having from 1 to 10 carbon atoms, an alkyl group having from 2 to 10 carbon atoms and substituted by hydroxy, morpholino or aryl, an unsubstituted aryl group, an aryl group substituted by an alkyl group, an alkoxy group or a halogen atom, or R is a 2-pyridyl group, or represented by the general formula

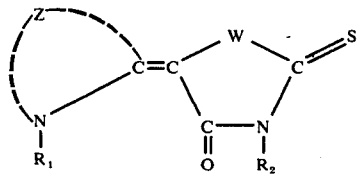

(II)

wherein W is a sulfur atom, a selenium atom, an oxygen atom, or a $>N—R_3$ group, $R_1$, $R_2$ and $R_3$ each is an unsubstituted alkyl group, a substituted alkyl group wherein the substituent is carboxy or sulfo, and wherein Z represents the atoms required to form a heterocyclic ring selected from the group consisting of a benzothiazole ring, a naphthothiazole ring, a benzoxazole ring, a naphthoxazole ring, a benzoselenazole ring, a naphthoselenazole ring, an indolenine ring, a benzimidazole ring, a naphthimidazole ring, and a 2-quinoline ring, said heterocyclic ring being unsubstituded or substituted on the benzene ring with a halogen atom, a phenyl group, an unsubstituted alkyl group, an alkoxy group, or a hydroxy group, or substituted on the naphthalene ring with an alkoxy group; or Z represents the atoms required to form a heterocyclic ring selected from the group consisting of a thiazoline ring, a thiazole ring, an oxazole ring, a selenazole ring, and a 2-pyridine ring, said heterocyclic ring being unsubstituted or substituted on the atoms represented by Z with an unsubstituted alkyl or an unsubstituted aryl group.

2. The method for forming photographic images as claimed in claim 1, wherein said compound of the general formla (I) is a compound of the formula Ia, Ib, or Ic

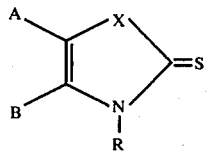

Ia

-continued

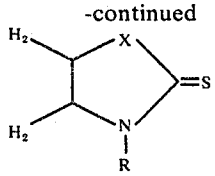

Ib

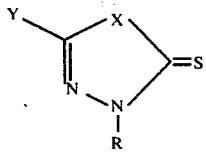

Ic wherein A and B each represents a member selected from the group consisting of a hydrogen atom, an unsubstituted alkyl group, an alkyl group substituted by a hydroxy group or halogen atom, an unsubstituted aryl group, an aryl group substituted by an alkyl group, a hydroxy group, or a halogen atom, an alkoxycarbonyl group and the atoms which combine with each other to form a member selected from the group consisting of a benzene ring, a benzene ring substituted by an unsubstituted alkyl group, an unsubstituted aryl group, a halogen substituted aryl group, an alkyl substituted aryl group, an alkoxy substituted aryl group, an alkoxy group or a halogen atom, a cyclopentene ring and a cyclohexene ring; X represents a sulfur atom, a selenium atom, an oxygen atom, a group represented by >N—R'' or a —CH=CH—group; Y represents an unsubstituted alkyl group, an alkoxy group or an alkylthio group; R and R'' each represents a member selected from the group consisting of an unsubstituted alkyl group of from 1 to 10 carbon atoms, an alkyl group having 4 to 10 carbon atoms substituted by a hydroxy group or a morpholino group, an aralkyl group substituted by a halogen atom or an alkoxy group, an unsubstituted aryl group, an aryl group substituted by an alkyl group, an alkoxy group, or a halogen atom, and a 2-pyridyl group; and wherein said compound of the general formula II is a compound of the formula II*a* or II*b*

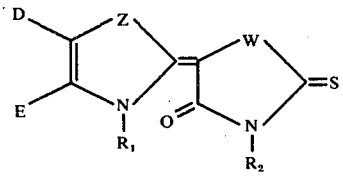

IIa

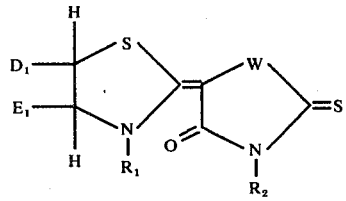

IIb wherein D and E each represents a member selected from the group consisting of a hydrogen atom, an unsubstituted alkyl group, an unsubstituted aralkyl group, an alkoxycarbonyl group, an unsubstituted aryl group, an aryl group substituted by halogen, alkyl or alkoxy, and the atoms which combine with each other to form a member selected from the group consisting of a benzene ring, a benzene ring substituted by a halogen atom, a phenyl group, an unsubstituted alkyl group, an alkoxy group or a hydroxy group, the atoms which combine with each other to form a naphthalene ring or an alkoxy-substituted naphthalene ring, and the atoms which combine with each other to form a cyclohexene ring; Z represents a sulfur atom, an oxygen atom, a selenium atom, a group $>C(R_4)_2$, a group $>N-R_5$ or the group —CH=CH—; W represents a sufur atom, a selenium atom, an oxygen atom or a group $>N—R_3$; $R_1$, $R_2$, $R_3$ and $R_5$ each represents a member selected from the group consisting of an unsubstituted alkyl group and an alkyl group substituted by a carboxy group or a sulfo group; $R_4$ represents an unsubstituted alkyl group; $D_1$ and $E_1$ each represents a hydrogen atom, an unsubstituted alkyl group, an unsubstituted aryl group or an aryl group substituted by halogen, alkyl or alkoxy.

3. The method of claim 1, wherein the compound of the formula I is used.

4. The method of claim 1, wherein the compound of the formula II is used.

5. The method of claim 2, wherein the compound of the formula I*a* is used.

6. The method of claim 2, wherein the compound of the formula I*b* is used.

7. The method of claim 2, wherein the compound of the formula I*c* is used.

8. The method of claim 2, wherein the compound of the formula II*a* is used.

9. The method of claim 2, wherein the compound of the formula II*b* is used.

10. The method of claim 7, wherein Y is a methyl group, an ethyl group, an n-butyl group, an n-hexyl group, a methoxy group, an ethoxy group, a methylthio group, an ethylthio group or a 2-(4-phenyl-5-thio-1,3,4-thiazdiazoline-2-yl)mercaptoethylthio group.

11. The method of claim 1, wherein said developing is in a developer containing a small amount of soluble iodide.

12. The method of claim 1, wherein the silver halide light-sensitive element contains a compound capable of imagewise releasing iodide ions during the developing.

13. The method of claim 1, wherein said developing is in a developer containing image-wise releasing iodide ions.

14. The method of claim 1, wherein $R_1$, $R_2$, and $R_3$ in the general formula II are selected from a methyl group, an ethyl group, an n-propyl group, an n-butyl group, an isobutyl group, an n-amyl group, a carboxymethyl group, a carboxyethyl group, a sulfomethyl group, a sulfopropyl group, or a sulfobutyl group.

15. The method for forming photographic images as claimed in claim 1, wherein said alkylene oxide polymer is selected from the group consisting of polyalkylene glycols and condensation products of polyalkylene oxide with an alcohol, an amine, a mercaptan, an organic acid, an amide, acetylene or dibenzoyl methane, wherein the alkylene oxide chain of said alkylene oxide polymer has a molecular weight of at least 300 and the alkylene oxide units thereof have from 2 to 4 carbon atoms.

16. The method for forming photographic images as claimed in claim 1, wherein said alkylene oxide polymer is selected from the group consisting of polyalkylene glycols and condensation products of polyalkylene oxide with an aliphatic alcohol, an aliphatic acid, an aliphatic amine, an aliphatic amide, a phenol or a hexitol ring-dehydration product, and wherein the polyalkylene oxide chain of said alkylene oxide polymer has a molecular weight of at least 300 and the alkylene oxide unit thereof has from 2 to 4 carbon atoms.

17. The method for forming photographic images as claimed in claim 1, wherein said polyalkylene oxide chain of the alkylene oxide polymer is an ethylene oxide chain or a propylene oxide chain and the molecular weight thereof is at least 400.

18. The method for forming photographic images as claimed in claim 1, wherein the silver halide light-sensitive element contains per mole of silver halide from 0.1 to 10 g of alkylene oxide polymer and per mole of silver halide from 0.006 to 2.5 g of a compound of the general formula I.

19. The method for forming photographic images as claimed in claim 1, wherein the silver halide light-sensitive element contains per mole of silver halide from 0.1 to 10 g of the alkylene oxide polymer and per mole of silver halide from 0.003 to 1.0 g of a compound of the general formula II.

20. The method for forming photographic images as claimed in claim 1, wherein the silver halide light-sensitive element contains per mole of silver halide from 0.1 to 10 g of the alkylene oxide polymer and wherein said developing is in a developer containing, per liter of developer from 0.005 to 0.5 g of a compound of the general formula I.

21. The method for forming photographic images as claimed in claim 1, wherein the silver halide light-sensitive element contains per mole of silver halide from 0.1 to 10 g of the alkylene oxide polymer, and wherein said developing is in a developer containing per liter of developer from 0.003 to 0.3 g of a compound of the general formula II.

22. The method for forming photographic images as claimed in claim 1, wherein the silver halide light-sensitive element contains per mole of silver halide from 0.006 to 2.5 g of a compound of the general formula I and wherein said developing is in a developer containing per liter of developer from 0.05 to 5.0 g of the alkylene oxide polymer.

23. The method for forming photographic images as claimed in claim 1, wherein the silver halide light-sensitive element contains per mole of silver halide from 0.003 to 1.0 g of a compound of the general formula II and wherein said developing is in a developer containing per liter of developer from 0.05 to 5.0 g of the alkylene oxide polymer.

24. The method for forming photographic images as claimed in claim 1, wherein said developing is in a developer containing per liter of developer from 0.05 to 5.0 g of the alkylene oxide polymer and from 0.005 to 0.5 g of a compound of the general formula I in combination.

25. The method for forming photographic images as claimed in claim 1, wherein said developing is in a developer containing per liter of developer from 0.05 to 5.0 g of the alkylene oxide polymer and from 0.003 to 0.3 g of a compound of the general formula II in combination.

26. The method for forming photographic images as claimed in claim 1, wherein said silver halide photographic emulsion layer contains from 1 to 10 mole percent of silver iodide.

27. The method for forming photographic images as claimed in claim 1, wherein said alkylene oxide polymer is a polyethylene glycol polymer having a molecular weight of from 1,000 to 3,500 or a condensation product of polyethylene oxide with active hydrogen containing organic compounds having a molecular weight of from 1,000 to 3,500.

* * * * *